US009385490B2

(12) United States Patent
Ando et al.

(10) Patent No.: US 9,385,490 B2
(45) Date of Patent: Jul. 5, 2016

(54) SWITCH-EQUIPPED CONNECTOR

(71) Applicant: MURATA MANUFACTURING CO., LTD., Kyoto (JP)

(72) Inventors: Masamichi Ando, Kyoto (JP); Shinichi Kenzaki, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 15 days.

(21) Appl. No.: 14/073,609

(22) Filed: Nov. 6, 2013

(65) Prior Publication Data

US 2014/0065845 A1 Mar. 6, 2014

Related U.S. Application Data

(63) Continuation of application No. PCT/JP2012/053848, filed on Feb. 17, 2012.

(30) Foreign Application Priority Data

Jun. 2, 2011 (JP) ..... 2011-124021

(51) Int. Cl.
*H01R 29/00* (2006.01)
*H01R 13/70* (2006.01)
*H01R 24/46* (2011.01)

(52) U.S. Cl.
CPC ..... *H01R 13/70* (2013.01); *H01R 24/46* (2013.01)

(58) Field of Classification Search
CPC ..... H01H 36/0073
USPC ..... 335/205; 439/63, 188
See application file for complete search history.

(56) References Cited

U.S. PATENT DOCUMENTS

| | | | | |
|---|---|---|---|---|
| 6,068,499 | A * | 5/2000 | Kuriyama et al. | 439/188 |
| 6,808,405 | B1 * | 10/2004 | Uratani et al. | 439/188 |
| 7,264,479 | B1 | 9/2007 | Lee | |
| 7,527,501 | B2 * | 5/2009 | Kuroda et al. | 439/63 |
| 7,760,057 | B2 * | 7/2010 | Leipold et al. | 335/151 |
| 7,794,253 | B2 * | 9/2010 | Wang et al. | 439/188 |
| 8,066,516 | B2 * | 11/2011 | Hoshiba et al. | 439/63 |
| 8,133,066 | B2 * | 3/2012 | Beak et al. | 439/188 |
| 8,309,868 | B2 * | 11/2012 | Tuin et al. | 200/51.12 |
| 8,678,836 | B2 * | 3/2014 | Kenzaki et al. | 439/63 |
| 2004/0229486 | A1 * | 11/2004 | Uratani et al. | 439/188 |
| 2008/0067044 | A1 | 3/2008 | Schwartzbart et al. | |

(Continued)

FOREIGN PATENT DOCUMENTS

| | | |
|---|---|---|
| JP | 09-306605 A | 11/1997 |
| JP | 10-010217 A | 1/1998 |

(Continued)

OTHER PUBLICATIONS

International Search Report; PCT/JP2012/053848; Apr. 24, 2012.

(Continued)

*Primary Examiner* — Alexander Talpalatski
(74) *Attorney, Agent, or Firm* — Studebaker & Brackett PC

(57) ABSTRACT

A switch-equipped connector that can reduce the occurrence of intermodulation distortion includes a first terminal, a second movable terminal, and a magnet provided at a position distant from the first and second terminals. At least one of the first and the second terminal has a magnetic metal and the second terminal is configured to come into and out of contact with the first terminal.

10 Claims, 7 Drawing Sheets

(56) References Cited

U.S. PATENT DOCUMENTS

| | | | | |
|---|---|---|---|---|
| 2010/0029110 | A1 | 2/2010 | Kiryu et al. | |
| 2011/0117759 | A1* | 5/2011 | Beak et al. | 439/92 |

FOREIGN PATENT DOCUMENTS

| | | | |
|---|---|---|---|
| JP | 2004-247625 | A | 9/2004 |
| JP | 2004-281179 | A | 10/2004 |
| JP | 2004-281180 | A | 10/2004 |
| JP | 2004-342501 | A | 12/2004 |
| JP | 2008-078134 | A | 4/2008 |
| JP | 2009-539224 | A | 11/2009 |
| JP | 2010-056055 | A | 3/2010 |

OTHER PUBLICATIONS

Written Opinion of the International Searching Authority; PCT/JP2012/053848; Apr. 24, 2012.

An Office Action; "Notice of Reasons for Rejection," issued by the Japanese Patent Office on Oct. 21, 2014, which corresponds to Japanese Patent Application No. 2013-517894 and is related to U.S. Appl. No. 14/073,609.

* cited by examiner

SWITCH-EQUIPPED CONNECTOR

CROSS REFERENCE TO RELATED APPLICATIONS

The present application is a continuation of International Application No. PCT/JP2012/053848 filed on Feb. 17, 2012, and claims priority to Japanese Patent Application No. 2011-124021 filed on Jun. 2, 2011, the entire contents of each of these applications being incorporated herein by reference in their entirety.

TECHNICAL FIELD

The technical field relates to a switch-equipped connector, and specifically relates to a switch-equipped connector through which high-frequency signals are transmitted.

BACKGROUND

As a conventional switch-equipped connector, for example, a coaxial connector described in Japanese Unexamined Patent Application Publication No. 2004-342501 (Patent Document 1) is known. FIG. 8 is a cross-sectional structural view of a coaxial connector 500 described in Patent Document 1.

As illustrated in FIG. 8, the coaxial connector 500 includes a yoke terminal 502, a movable terminal 504, a yoke terminal 506, and a magnet 508.

The yoke terminals 502 and 506 face each other with the magnet 508 interposed therebetween, and are in contact with the magnet 508. Normally, as illustrated in FIG. 8(*a*), a magnetic force of the magnet 508 causes the movable terminal 504 to be in contact with the yoke terminals 502 and 506. This provides electrical continuity between the yoke terminal 502 and the yoke terminal 506.

When a probe 600 is inserted, as illustrated in FIG. 8(*b*), the movable terminal 504 is pushed downward and away from the yoke terminal 506 by the probe 600. Thus, the yoke terminal 502 and the yoke terminal 506 are insulated from each other.

In the coaxial connector 500 described above, contacts of the yoke terminals 502 and 506 with the movable terminal 504 are subjected to primary nickel plating and surface gold plating. Since the contacts are surface-plated with gold, it is possible to prevent corrosion of the contacts and improve contact reliability between the movable terminal 504 and the yoke terminals 502 and 506.

SUMMARY

The present disclosure provides a switch-equipped connector that can reduce the occurrence of intermodulation distortion.

A switch-equipped connector according to an embodiment is a switch-equipped connector used to transmit high-frequency signals and including a first terminal, a second terminal, and a magnet provided at a position distant from the first terminal and the second terminal. At least one of the first terminal and the second terminal includes a magnetic metal, and the second terminal is configured to come into and out of contact with the first terminal.

BRIEF DESCRIPTION OF DRAWINGS

FIG. 6(*b*) is a cross-sectional structural view of the switch-equipped connector on which a counterpart connector is mounted, as taken along the x-z plane.

DETAILED DESCRIPTION

The inventors realized that in the coaxial connector 500 described in Patent Document 1, it is highly likely that intermodulation distortion occurs, as described below. As described above, the yoke terminals 502 and 506 are each coated with a nickel plating film formed under a gold plating film. The nickel plating film has a high permeability when formed by electrolytic plating.

For example, a high-frequency signal having a frequency of about 1 GHz is transmitted through the coaxial connector 500. Because of a skin effect, the current flow of such a high-frequency signal is concentrated near skins of the yoke terminals 502 and 506. A skin depth δ at which the current density is attenuated to 1/e (≈0.37) can be expressed by equation (1) below.

$$\delta=(\pi f\sigma\mu_0\mu_r)^{-1/2} \quad (1)$$

σ: conductivity f: frequency of high-frequency signal $\mu_0$: space permeability ($=4\pi\times10^{-7}$)

$\mu_r$: relative permeability

When the frequency f of the high-frequency signal is 1 GHz, the skin depth δ of gold is 2.36 μm according to equation (1). The thickness of a gold plating film is generally set to 1 μm or less in consideration of cost. Therefore, the current of a high-frequency signal also flows in the nickel plating film under the gold plating film. It is generally said that when current of a strong high-frequency signal flows in a metal having magnetic properties, that is, a metal having a relative permeability $\mu_r$ of greater than 1, intermodulation distortion occurs because of the following principles.

In a magnetic metal having a high permeability, the skin depth δ, which corresponds to an area where a high-frequency current flows, is small and the current density near the skin of a conductor is very large. Because of the large current density, the permeability (relative permeability $\mu_r$) of the skin portion decreases. When the permeability (relative permeability $\mu_r$) decreases, the skin depth δ increases and the current density in the surface layer of the magnetic metal decreases.

When the current density in the surface layer decreases, the permeability (relative permeability $\mu_r$) of the magnetic metal increases again (but does not exceed the original permeability). When the permeability (relative permeability $\mu_r$) increases, the skin depth δ decreases and the current density in the surface layer of the magnetic metal increases.

As described above, the current density changes with changes in the skin depth δ. The change in current density results in a change in ohmic loss, so that the current changes nonlinearly with respect to changes in voltage. The yoke terminals 502 and 506 are plated with nickel having magnetic properties. This results in the occurrence of intermodulation distortion when a large high-frequency current passes through the coaxial connector 500.

A switch-equipped connector according to an embodiment of the present disclosure will now be described with reference to the drawings.

Figure 1:
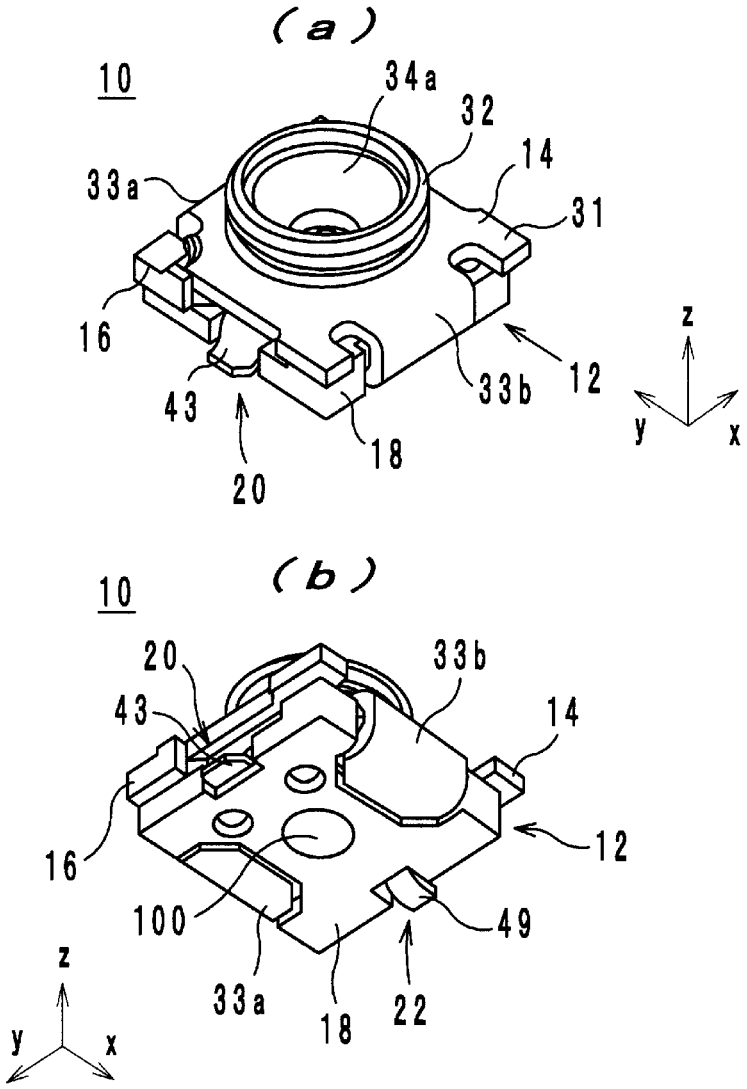
FIG. 1 is an external perspective view of a switch-equipped connector according to an exemplary embodiment.
Figure 2:
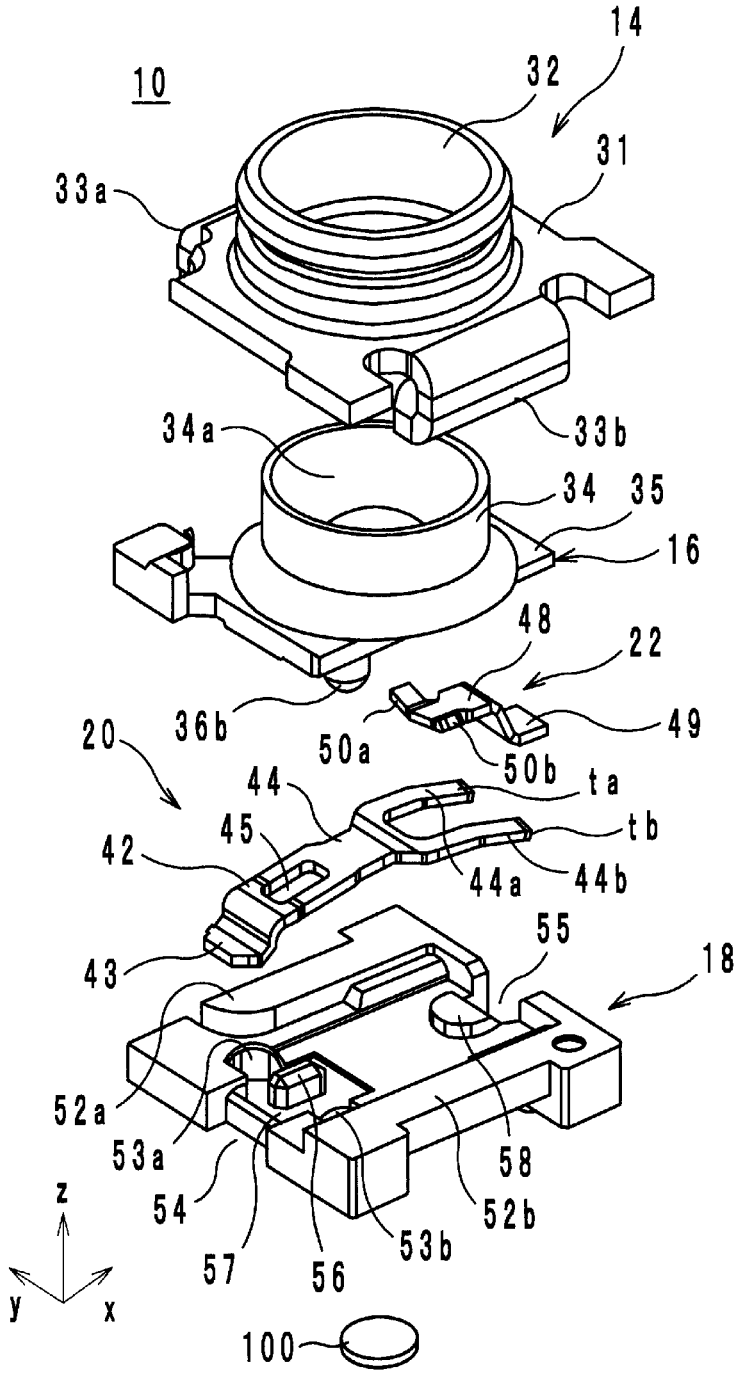
FIG. 2 is an exploded perspective view of the switch-equipped connector illustrated in FIG. 1.
Figure 3:
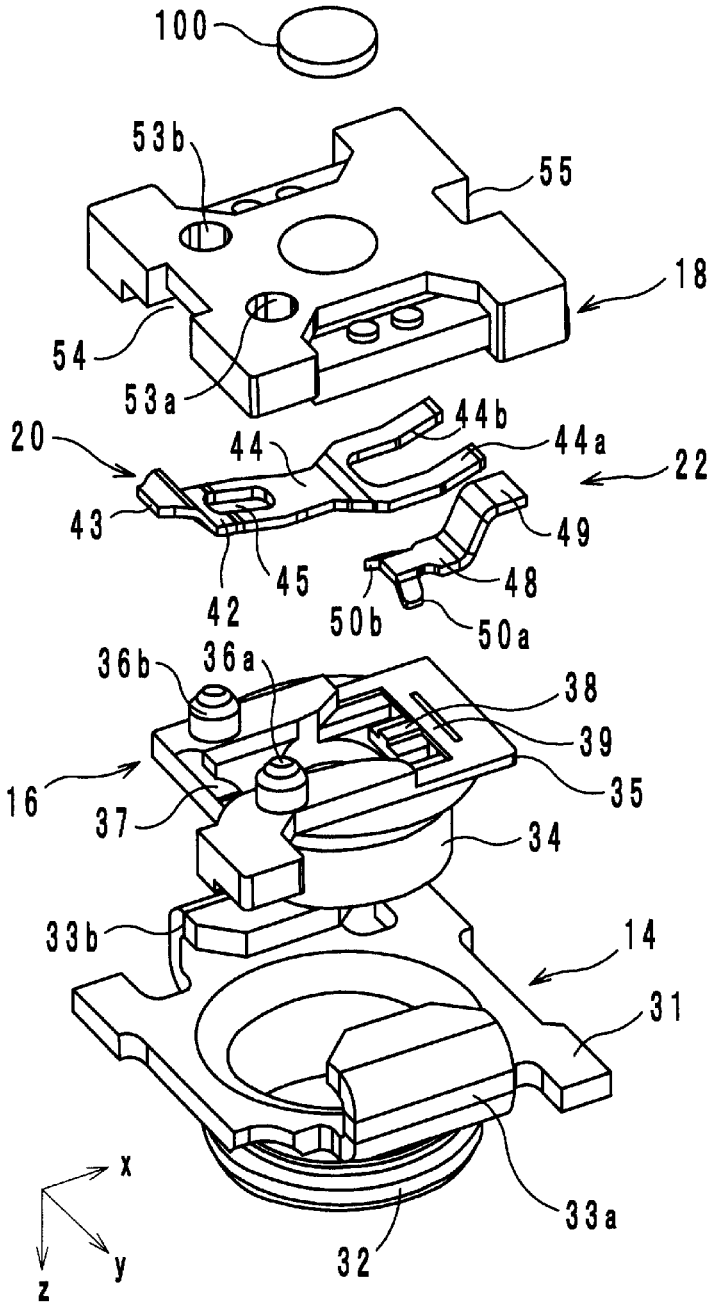
FIG. 3 is an exploded perspective view of the switch-equipped connector illustrated in FIG. 1.

Configuration of switch-equipped connector: FIG. 1 is an external perspective view of a switch-equipped connector 10 according to an exemplary embodiment of the present disclosure. FIGS. 2 and 3 are each an exploded perspective view of the switch-equipped connector 10. The switch-equipped connector 10 will now be described in detail. In FIGS. 1 to 3, a direction in which an external terminal 14, an upper case 16, and a lower case 18 are stacked is defined as a z-axis direction. The positive direction of the z-axis direction is a direction directed from the lower case 18 toward the external terminal 14. A direction in which a movable terminal 20 and a fixed terminal 22 are arranged is defined as an x-axis direction. A direction orthogonal to both the x-axis direction and the z-axis direction is defined as a y-axis direction. The positive direction of the x-axis direction is a direction directed from the movable terminal 20 toward the fixed terminal 22.

The switch-equipped connector 10 is used to transmit high-frequency signals. As illustrated in FIG. 1, the switch-equipped connector 10 includes a main body 12, the movable terminal 20, the fixed terminal 22, and a magnet 100 and measures 2 mm by 2 mm by 0.9 mm. As illustrated in FIG. 2, the main body 12 is formed by stacking the external terminal 14 of metal, and the upper case 16 and the lower case 18 of resin, which is an insulating material, in this order from the positive side to the negative side in the z-axis direction.

As illustrated in FIG. 2, the lower case 18 is rectangular in shape. The lower case 18 is provided with protrusions 52*a* and 52*a* for positioning the upper case 16, on a surface on the positive side in the z-axis direction. The protrusions 52*a* and 52*a* extend in the x-axis direction along sides located on both ends of the lower case 18 in the y-axis direction. The lower case 18 is also provided with holes 53*a* and 53*b*.

As illustrated in FIG. 2, the lower case 18 is provided with rectangular notches 54 and 55 in respective central portions of two sides extending in the y-axis direction. The notches 54 and 55 are provided for allowing the movable terminal 20 and the fixed terminal 22, respectively, to extend outward. A protrusion 56 for positioning the movable terminal 20 is provided near and on the positive side of the notch 54 in the x-axis direction. There is a fixing surface 57 for securing the movable terminal 20 between the notch 54 and the protrusion 56. A fixing surface 58 for securing the fixed terminal 22 is provided near and on the negative side of the notch 55 in the x-axis direction.

As illustrated in FIG. 2, the upper case 16 has a cylindrical portion 34 and a cover portion 35. The cover portion 35 is a plate-like member having an outer shape that follows the protrusions 52*a* and 52*b*. The cover portion 35 is fitted into the space between the protrusions 52*a* and 52*b*. In the center of the cover portion 35, the cylindrical portion 34 protrudes toward the positive side in the z-axis direction. The cylindrical portion 34 has a bowl shape that opens on the positive side in the z-axis direction. The cylindrical portion 34 has a hole 34*a* which is circular in a cross-section taken along the x-y plane. The hole 34*a* passes through the upper case 16. A probe of a counterpart connector is inserted into the hole 34*a* from the opening of the bowl shape.

As illustrated in FIG. 3, a surface of the upper case 16 on the negative side in the z-axis direction is provided with two cylindrical ribs 36*a* and 36*b* protruding toward the negative side in the z-axis direction. The upper case 16 and the lower case 18 are positioned by inserting the ribs 36*a* and 36*b* into the holes 53*a* and 53*b*, respectively, in the lower case 18.

As illustrated in FIG. 3, the surface of the upper case 16 on the negative side in the z-axis direction has a fixing surface 37 for securing the movable terminal 20 near an end on the negative side in the x-axis direction. When the switch-equipped connector 10 is assembled, the movable terminal 20 is sandwiched and secured between the fixing surface 37 and the fixing surface 57. Similarly, the surface of the upper case 16 on the negative side in the z-axis direction has a fixing surface 39 for securing the fixed terminal 22 near an end on the positive side in the x-axis direction. When the switch-equipped connector 10 is assembled, the fixed terminal 22 is sandwiched and secured between the fixing surface 39 and the fixing surface 58. Additionally, there is a holding portion 38 on the negative side of the fixing surface 39 in the x-axis direction. On the surface of the upper case 16 on the negative side in the z-axis direction, the holding portion 38 protrudes toward the negative side in the z-axis direction. A fixed portion 48 and contact portions 50*a* and 50*b* (described below) of the fixed terminal 22 are placed on the holding portion 38.

Figure 4:
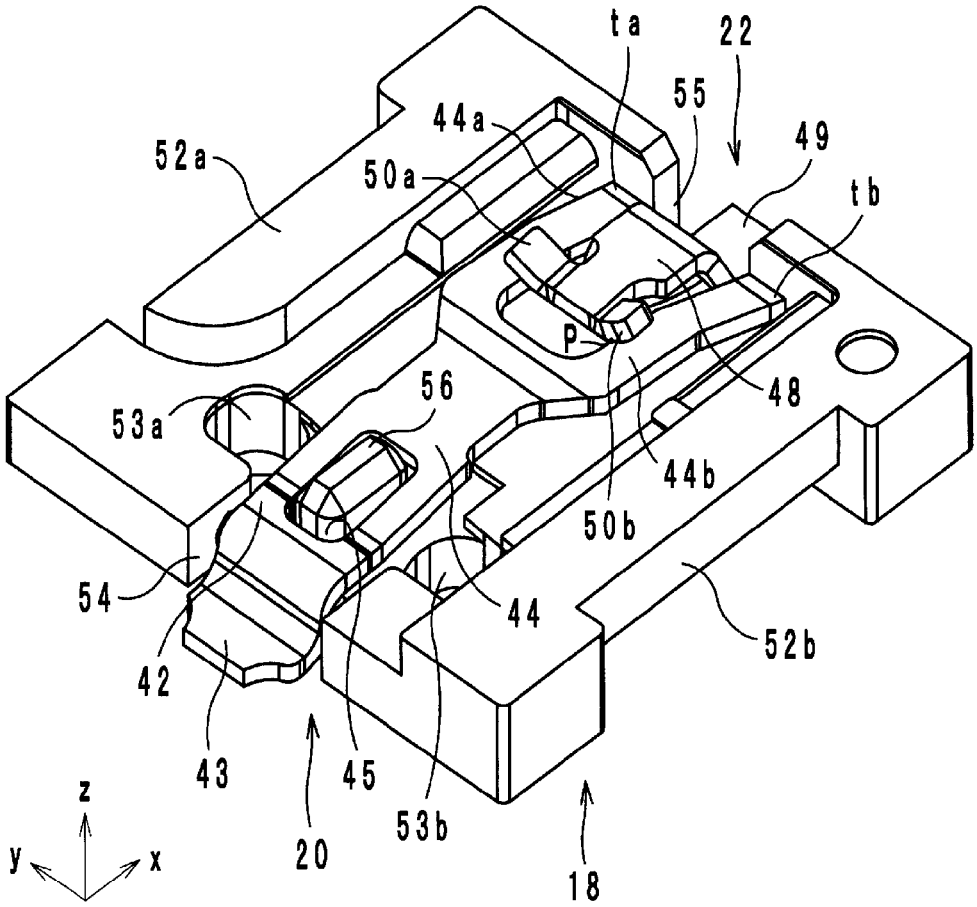
FIG. 4 is an external perspective view of a movable terminal and a fixed terminal mounted on a lower case.
Figure 5:
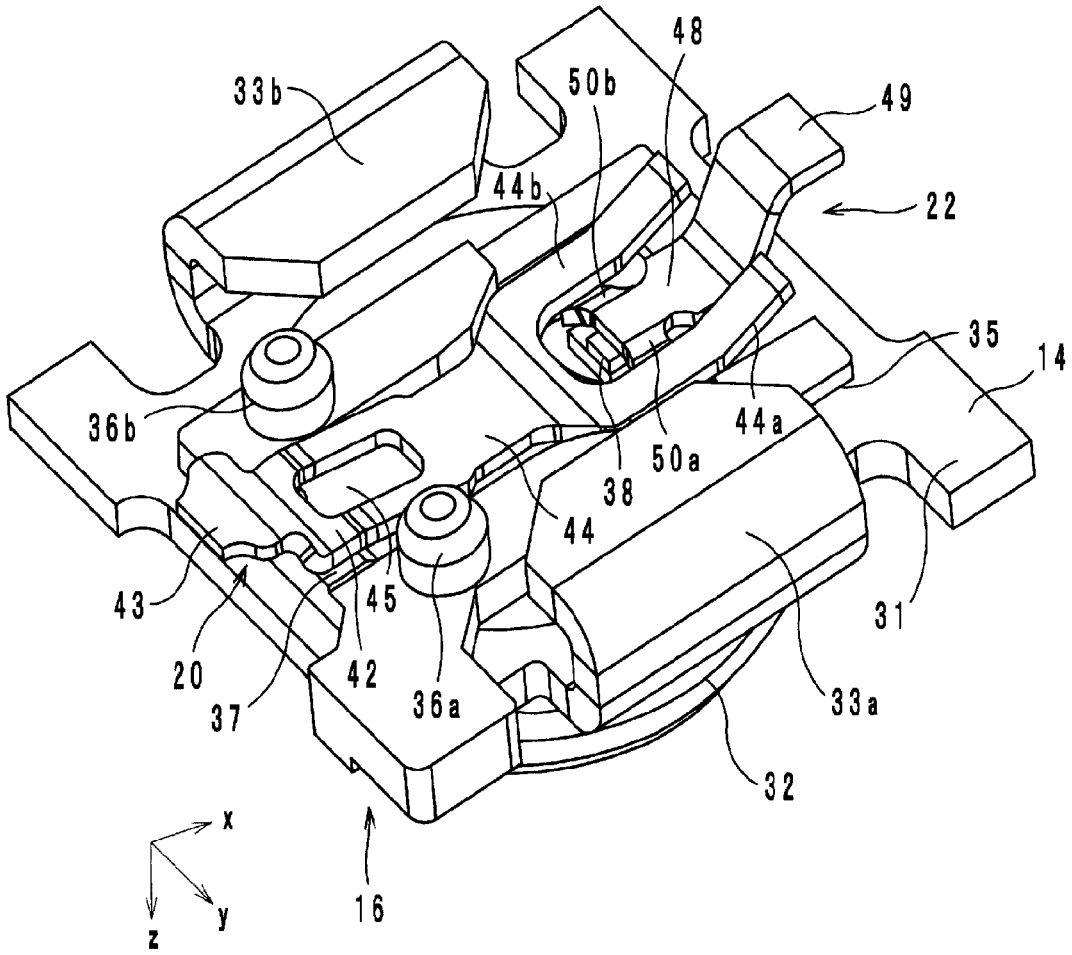
FIG. 5 is an external perspective view of the movable terminal and the fixed terminal mounted on an upper case.

Next, the movable terminal 20 and the fixed terminal 22 will be described with reference to FIGS. 1 to 5. FIG. 4 is an external perspective view of the movable terminal 20 and the fixed terminal 22 mounted on the lower case 18. FIG. 5 is an external perspective view of the movable terminal 20 and the fixed terminal 22 mounted on the upper case 16.

As illustrated in FIGS. 2 to 4, the fixed terminal 22 is mounted on the surface of the lower case 18 on the positive side in the z-axis direction. The fixed terminal 22 is formed by blanking and bending a metal plate of phosphor bronze (e.g., C5191R-1/2H). The surface of the fixed terminal 22 is Ni-plated and Au-plated. That is, after Ni plating is applied by electrolytic plating to the surface of the main body of the fixed terminal 22 made of metal (phosphor bronze), Au plating is applied to the Ni plating. The film thickness of the Ni plating ranges from 0.20 μm to 1.00 μm. The film thickness of the Au plating ranges from 0.030 μm to 0.20 μm. In mass production, it is preferable, in view of cost, that the fixed terminals 22 be supplied in the form of a hoop where they are arranged continuously. Since a hoop is generally plated by electrolytic plating, Ni plating typically has magnetic properties.

As illustrated in FIGS. 2 and 3, the fixed terminal 22 has the fixed portion 48, a lead portion 49, and the contact portions 50*a* and 50*b*. The fixed portion 48 is a flat portion secured to the main body 12 by being sandwiched between the fixing surface 39 and the fixing surface 58 when the switch-equipped connector 10 is assembled. The lead portion 49 is formed by bending a part of the fixed terminal 22 into an L-shape, the part being on the positive side of the fixed portion 48 in the x-axis direction. As illustrated in FIGS. 1 and 4, when the switch-equipped connector 10 is assembled, the lead portion 49 is exposed from the notch 55 to the outside of the main body 12. As illustrated in FIGS. 4 and 5, the contact portions 50*a* and 50*b* are formed by bending an end portion of the fixed terminal 22 toward the positive side in the z-axis direction, the end portion being on the negative side in the x-axis direction. The contact portions 50*a* and 50*b* are in contact with the movable terminal 20 in areas that face toward the negative side in the z-axis direction. There are two contact portions 50*a* and 50*b* that correspond to branch portions 44*a* and 44*b*, respectively, described below. Bend lines between the fixed portion 48 and the contact portions 50*a* and 50*b* are parallel to the x-axis direction. As illustrated in FIG. 5, the fixed portion 48 between the contact portions 50*a* and 50*b* and the contact portions 50*a* and 50*b* are placed on the holding portion 38 having a shape that follows the shapes of the contact portions 50*a* and 50*b* and fixed portion 48.

As illustrated in FIGS. 2 to 4, the movable terminal 20 is mounted on the surface of the lower case 18 on the positive side in the z-axis direction. The movable terminal 20 is formed by blanking and bending a metal plate of austenitic spring stainless steel having spring properties (e.g., SUS301-CSP or SUS304-CSP). The surface of the movable terminal 20 is Ni-plated and Au-plated. That is, after Ni plating is applied by electrolytic plating to the surface of the main body of the movable terminal 20 made of metal (austenitic stainless steel), Au plating is applied to the Ni plating. The film thickness of the Ni plating ranges from 0.20 μm to 1.00 μm. The film thickness of the Au plating ranges from 0.030 μm to 0.20 μm. The main body of the movable terminal 20, which is formed by bending an austenitic stainless steel plate, undergoes martensitic transformation and has magnetic properties. In mass production, it is preferable, in view of cost, that the movable terminals 20 be also supplied in the form of a hoop where they are arranged continuously. Since a hoop is generally plated by electrolytic plating, Ni plating typically has magnetic properties.

As illustrated in FIGS. 2 and 3, the movable terminal 20 has a fixed portion 42, a lead portion 43, and a leaf spring portion 44. The fixed portion 42 is a flat portion secured to the main body 12 by being sandwiched between the fixing surface 37 and the fixing surface 57 when the switch-equipped connector 10 is assembled. The lead portion 43 is formed by bending a part of the movable terminal 20 into an L-shape, the part being on the negative side of the fixed portion 42 in the x-axis direction. As illustrated in FIGS. 1 and 4, when the switch-equipped connector 10 is assembled, the lead portion 43 is exposed from the notch 54 to the outside of the main body 12.

As illustrated in FIG. 4, the leaf spring portion 44 linearly extends from the fixed portion 42 toward the fixed terminal 22 in the x-axis direction. The leaf spring portion 44 is in contact with the contact portions 50*a* and 50*b* of the fixed terminal 22 and is, at the same time, slidably in contact with the lower case 18 at tips ta and tb thereof. Specifically, the leaf spring portion 44 has two branch portions 44*a* and 44*b* adjacent to the tips ta and tb (on the positive side in the x-axis direction). The fixed portion 48 is located between the branch portions 44*a* and 44*b*. Toward the positive side in the z-axis direction, the contact portions 50*a* and 50*b* of the fixed terminal 22 extend outward in the y-axis direction such that they overlap with the branch portions 44*a* and 44*b* in plan view in the z-axis direction. The leaf spring portion 44 is curved to protrude toward the positive side in the z-axis direction. Therefore, the branch portions 44*a* and 44*b* are pressed into contact with the contact portions 50*a* and 50*b*, respectively, by a biasing force of the leaf spring portion 44. Thus, the movable terminal 20 and the fixed terminal 22 are separably pressed into contact with each other and electrically connected to each other.

A hole 45 is formed across the boundary of the leaf spring portion 44 and the fixed portion 42. As illustrated in FIG. 4, the protrusion 56 is inserted into the hole 45. Thus, the movable terminal 20 is positioned in the x-y plane.

The movable terminal 20 and the fixed terminal 22 have the configurations described above. As illustrated in FIG. 5, the fixed terminal 22 is first attached to the upper case 16, and then the movable terminal 20 is attached to the upper case 16. Thus, parts of the branch portions 44*a* and 44*b* on the positive side in the z-axis direction are brought into contact with respective parts of the contact portions 50*a* and 50*b* on the negative side in the z-axis direction.

The external terminal 14 is formed, for example, by blanking, bending, and drawing a metal plate of brass or beryllium copper. The surface of the external terminal 14 is Au-plated. The external terminal 14 comes into contact with an outer conductor of the counterpart connector. As illustrated in FIGS. 1 and 2, the external terminal 14 has a flat portion 31, a cylindrical portion 32, and leg portions 33*a* and 33*b*.

The flat portion 31 is a plate-like member that covers the upper case 16 from the positive side in the z-axis direction. The flat portion 31 has the leg portions 33*a* and 33*b* on respective sides located on both ends thereof in the y-axis direction. The leg portions 33*a* and 33*b* are formed by bending parts of plate-like bodies extending from the flat portion 31 in the y-axis direction. As illustrated in FIG. 1, the leg portions 33*a* and 33*b* hold and secure the upper case 16 and the lower case 18 together. The central portion of the flat portion 31 is provided with the cylindrical portion 32 protruding toward the positive side in the z-axis direction. The cylindrical portion 32 is formed to be concentric with the cylindrical portion 34, and fitted with the outer conductor of the counterpart connector. The external terminal 14 normally serves as an earth or a ground.

The magnet 100 is provided at a position distant from the fixed terminal 22 and the movable terminal 20. Specifically, the magnet 100 is mounted on the surface of the lower case 18 on the negative side in the z-axis direction. In the present embodiment, the magnet 100 overlaps with the movable terminal 20 in plan view in the z-axis direction.

The switch-equipped connector 10 configured as described above is assembled in the following manner. As illustrated in FIG. 5, after the fixed terminal 22 is positioned and attached to the upper case 16, the movable terminal 20 is positioned and attached to the upper case 16.

Next, as illustrated in FIG. 5, the external terminal 14 is attached to the upper case 16 from the positive side in the z-axis direction. This allows the cylindrical portion 34 to be inserted into the cylindrical portion 32. Note that although the leg portions 33*a* and 33*b* are bent in FIG. 5, the leg portions 33*a* and 33*b* have not yet been actually bent at this stage. Then, as illustrated in FIG. 3, the lower case 18 is stacked onto the upper case 16 from the negative side in the z-axis direction. This allows the ribs 36*a* and 36*b* to be inserted into the holes 53*a* and 53*b*, respectively.

Next, the leg portions 33*a* and 33*b* of the external terminal 14 are crimped.

Last, with an adhesive or the like, the magnet 100 is attached to the surface of the lower case 18 on the negative side in the z-axis direction. Thus, the switch-equipped connector 10 having the structure illustrated in FIG. 1 is obtained.

Figure 6:
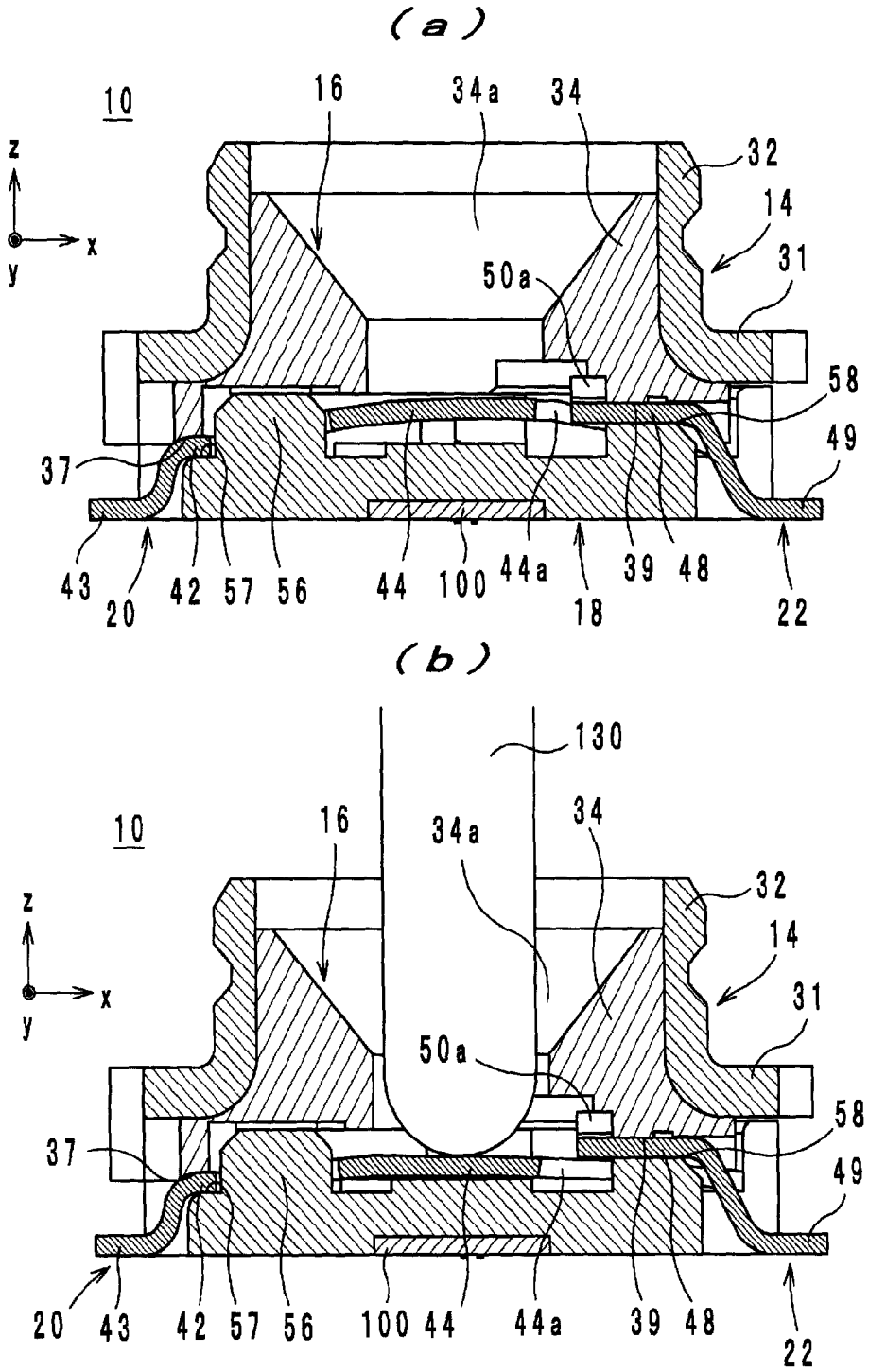
FIG. 6(*a*) is a cross-sectional structural view of the switch-equipped connector on which no counterpart connector is mounted, as taken along an x-z plane.

Operation of switch-equipped connector: Next, the operation of the switch-equipped connector 10 will be described with reference to FIG. 6. FIG. 6(*a*) is a cross-sectional structural view of the switch-equipped connector 10 on which no counterpart connector is mounted, as taken along the x-z plane. FIG. 6(*b*) is a cross-sectional structural view of the switch-equipped connector 10 on which a counterpart connector is mounted, as taken along the x-z plane.

As illustrated in FIG. 6(*a*), when no counterpart connector is mounted, the central portion of the movable terminal 20 in the x-axis direction bulges toward the positive side in the z-axis direction. Thus, the branch portions 44*a* and 44*b* (only the branch portion 44*a* is shown in FIG. 6) are pressed into contact with the contact portions 50*a* and 50*b* (only the contact portion 50*a* is shown in FIG. 6), respectively, by a biasing force of the leaf spring portion 44, so that the movable terminal 20 and the fixed terminal 22 are electrically connected to each other.

On the other hand, when a counterpart connector is mounted, a probe 130 of the counterpart connector is inserted through the hole 34*a* from the positive side to the negative side in the z-axis direction. Thus, the probe 130 comes into contact with the leaf spring portion 44 and pushes it downward toward the negative side in the z-axis direction. That is, the leaf spring portion 44 is displaced by the probe 130 in a direction away from the fixed terminal 22. Thus, as illustrated in FIG. 6(*b*), the branch portions 44*a* and 44*b* of the leaf spring portion 44 are separated from the contact portions 50*a* and 50*b* and the movable terminal 20 and the fixed terminal 22 are electrically disconnected, whereas the probe 130 and the movable terminal 20 are electrically connected to each other. At the same time, the outer conductor (not shown) of the counterpart connector is fitted into and electrically connected to the external terminal 14.

When the counterpart connector is removed from the switch-equipped connector 10, the central portion of the leaf spring portion 44 in the x-axis direction is returned to the positive side in the z-axis direction as illustrated in FIG. 6(*a*). Thus, the movable terminal 20 and the fixed terminal 22 are electrically connected to each other again, whereas the probe 130 and the movable terminal 20 are electrically disconnected from each other.

Effects: The switch-equipped connector 10 configured as described above can reduce the occurrence of corrosion at contacts of the movable terminal 20 with the fixed terminal 22. Specifically, since the surface of the movable terminal 20 of the switch-equipped connector 10 is coated with gold plating having good environmental resistance, the contacts of the movable terminal 20 with the fixed terminal 22 are protected by gold. This can reduce the occurrence of corrosion at the contacts of the movable terminal 20 with the fixed terminal 22.

The switch-equipped connector 10 can also reduce the occurrence of intermodulation distortion. In the coaxial connector 500 described in Patent Document 1, the yoke terminals 502 and 506 are each coated with a nickel plating film formed under a gold plating film. The nickel plating film has a high permeability when formed by electrolytic plating. This results in the occurrence of intermodulation distortion in the coaxial connector 500.

On the other hand, the switch-equipped connector 10 includes the magnet 100. The magnet 100 brings about magnetic saturation in the main body of the movable terminal 20 and the Ni plating. That is, the relative permeabilities $\mu_r$ of the main body of the movable terminal 20 and the Ni plating approach 1. Thus, the occurrence of intermodulation distortion in the switch-equipped connector 10 can be reduced.

Additionally, the switch-equipped connector 10 can reduce the occurrence of intermodulation distortion for the following reasons. Specifically, when a high-frequency signal passes through the fixed terminal 22 and the movable terminal 20, an electromagnetic field is generated around the fixed terminal 22 and the movable terminal 20. The magnet 100, which is typically made of ferrite, is both a magnetic body and a dielectric body. When the magnet 100 is in contact with the fixed terminal 22 and the movable terminal 20 where an actual current flows, it is very likely that the current will change nonlinearly with respect to changes in voltage. If, as in the coaxial connector 500 described in Patent Document 1, the magnet 100 is in contact with one of the fixed terminal 22 and the movable terminal 20, many of magnetic fields generated by the current enter the magnet, and magnetic fields distorted in the magnet affect the current. As a result, the current changes nonlinearly with respect to changes in voltage, and intermodulation distortion occurs. Thus, in the switch-equipped connector 10, the magnet 100 is provided at a position distant from the fixed terminal 22 and the movable terminal 20. This reduces the amount of entry of magnetic fields generated by a high-frequency current into the magnet 100, and significantly reduces the amount of distorted magnetic fields that affect the current. Thus, the switch-equipped connector 10 can reduce the occurrence of intermodulation distortion. Note that each of the distance between the magnet 100 and the fixed terminal 22 and the distance between the magnet 100 and the movable terminal 20 is a design matter that can be determined by considering the size, material, and strength of the magnet 100, and the amount of power that flows through the connector, and by carrying out an experiment or the like.

The switch-equipped connector 10 can reduce the occurrence of corrosion in the main body of the movable terminal 20 made of austenitic stainless steel. Specifically, thin Au plating is a porous film, and Au has the lowest ionization tendency. Therefore, when Au plating is directly formed on the main body of the movable terminal 20, a stainless steel layer, which is a metal layer under the Au plating, is exposed through holes of the Au plating. If moisture in the air adheres to the exposed stainless steel, a galvanic cell effect occurs between the stainless steel and the Au plating. This causes a current to flow between the stainless steel and the Au plating. As a result, corrosion occurs in the stainless steel. Therefore, in the switch-equipped connector 10, Ni plating is formed under the Au plating. Since Ni plating is less corrosive than stainless steel, the switch-equipped connector 10 can reduce the occurrence of corrosion in the main body of the movable terminal 20.

In the switch-equipped connector 10, the Ni plating has magnetic properties because it is formed by electrolytic plating. On the other hand, Ni plating formed by electroless plating and containing more than or equal to 5% phosphorus (P) does not have magnetic properties. Therefore, it may be possible in the switch-equipped connector 10 to form Ni plating by electroless plating.

However, in the movable terminal 20, it is difficult to form Ni plating by electroless plating for the following reasons. The movable terminals 20 are fabricated by blanking and bending a belt-like hoop and plating the movable terminals 20 connected to the hoop. The movable terminals 20 are separated from the hoop and are each used in the switch-equipped connector 10. Since plating needs to be continuously applied to the plurality of movable terminals 20 connected to the hoop, electrolytic plating is used to plate the movable terminals 20. The reasons for generally not performing electroless plating in the application of continuous plating to a hoop are as follows:

1) it is difficult to achieve plating with good adhesion;
2) the operation is complicated due to many steps involved; and
3) it is difficult to continuously perform electroless plating because the length of processing time varies from one step to another.

In the switch-equipped connector 10, austenitic spring stainless steel is used to make the main body of the movable terminal 20. As described above, bending causes the austenitic stainless steel to undergo martensitic transformation and have magnetic properties. Therefore, as in the case of the main body of the fixed terminal 22, phosphor bronze may be used to make the main body of the movable terminal 20. Phosphor bronze is not given magnetic properties by bending.

However, since phosphor bronze generally has a spring constant smaller than that of austenitic spring stainless steel, a contact pressure between the movable terminal 20 and the fixed terminal 22 is reduced. To ensure firm contact between the fixed terminal 22 and the movable terminal 20, austenitic spring stainless steel having a large spring constant is preferably used to make the main body of the movable terminal 20.

Figure 7:
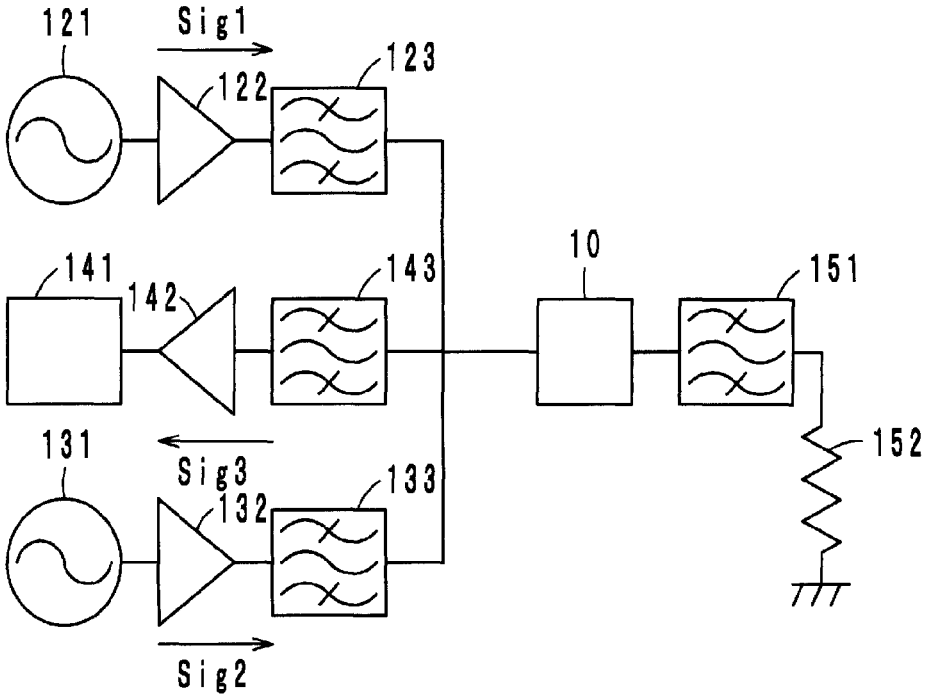
FIG. 7 is a block diagram of a circuit prepared for an experiment by the present inventors.
Figure 8:
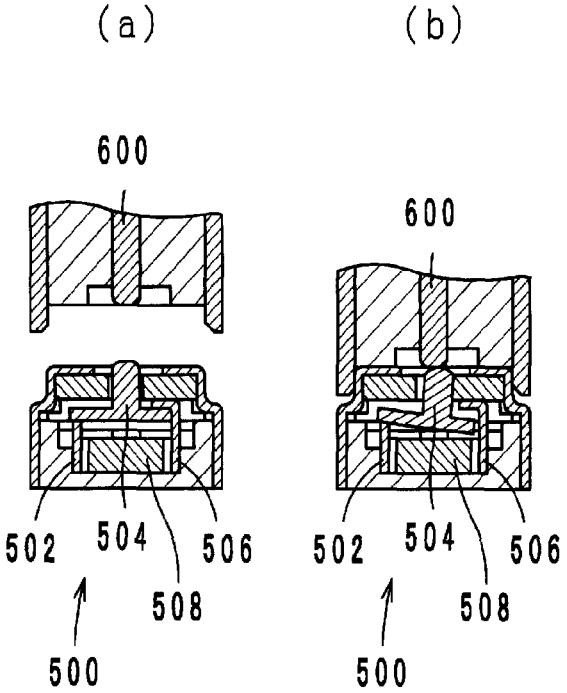
FIG. 8 Prior Art
FIG. 8 is a cross-sectional structural view of a coaxial connector described in Patent Document 1.

Experimental results: To confirm the effects of the switch-equipped connector 10 described above, the present inventors carried out an experiment described below. FIG. 7 is a block diagram of a circuit prepared for the experiment by the present inventors.

The circuit illustrated in FIG. 7 includes the switch-equipped connector 10, signal generators 121 and 131, power amplifiers 122 and 132, an amplifier 142, band pass filters 123, 133, 143, and 151, a spectrum analyzer 141, and a dummy load 152.

The signal generator 121 generates a high-frequency signal Sig1 having a frequency F1. The power amplifier 122 amplifies the high-frequency signal Sig1. The band pass filter 123 has a pass band that allows passage of the high-frequency signal Sig1, and an attenuation band where a high-frequency signal Sig2 and intermodulation distortion Sig3 described below are attenuated by not less than a predetermined amount.

The signal generator 131 generates the high-frequency signal Sig2 having a frequency F2 (>F1). The power amplifier 132 amplifies the high-frequency signal Sig2. The band pass filter 133 has a pass band that allows passage of the high-frequency signal Sig2, and an attenuation band where the high-frequency signal Sig1 and the intermodulation distortion Sig3 are attenuated by not less than a predetermined amount.

The band pass filter 143 has a pass band that allows passage of the intermodulation distortion Sig3 described below, and an attenuation band where the high-frequency signals Sig1 and Sig2 are attenuated by not less than a predetermined amount. The amplifier 142 amplifies an output from the band pass filter 143 and outputs the amplified output to the spectrum analyzer 141.

The high-frequency signals Sig1 and Sig2 that have passed through the switch-equipped connector 10 pass through the band pass filter 151 and are consumed by the dummy load 152. The band pass filter 151 prevents intermodulation distortion generated in the dummy load 152 from flowing back to the switch-equipped connector 10 and entering the amplifier 142.

When the high-frequency signals Sig1 and Sig2 are input to the switch-equipped connector 10, the intermodulation distortion Sig3 having a frequency FIM is generated in the switch-equipped connector 10. If the intermodulation distortion Sig3 is third-order intermodulation distortion, the frequency FIM can be expressed as 2F1-F2 or 2F2-F1. If the intermodulation distortion Sig3 is fifth-order intermodulation distortion, the frequency FIM can be expressed as 3F1-2F2 or 3F2-2F1. Higher-order intermodulation distortion may occur. After passing through the band pass filter 143, the intermodulation distortion Sig3 is amplified by the amplifier 142 and input to the spectrum analyzer 141. With the spectrum analyzer 141, the present inventors examined the strength of the third-order intermodulation distortion Sig3 generated in the switch-equipped connector 10. For comparison, the present inventors also examined the strength of the intermodulation distortion Sig3 generated in a switch-equipped connector having no magnet 100 in the same way.

In the present experiment, the strength of the third-order intermodulation distortion Sig3 generated in the switch-equipped connector having no magnet 100 was −103 dB to −105 dB, whereas the strength of the intermodulation distortion Sig3 generated in the switch-equipped connector 10 was −118 dB (measurement limit or less). This indicates that with the magnet 100, it is possible to reduce intermodulation distortion.

ADVANTAGEOUS EFFECTS OF INVENTION

Hence, embodiments according to the present disclosure make it possible to reduce the occurrence of not only corrosion at contacts of terminals, but also intermodulation distortion.

INDUSTRIAL APPLICABILITY

As described above, embodiments according to the present disclosure are useful when applied to a switch-equipped connector, and is particularly advantageous in that it can reduce the occurrence of intermodulation distortion.

That which is claimed is:

1. A switch-equipped connector used to transmit high-frequency signals, the switch-equipped connector comprising a first terminal, a second terminal, and a magnet provided at a position distant from the entirety of the first terminal and the entirety of the second terminal, wherein at least one of the first terminal and the second terminal has magnetic metal;

the first terminal has a lead at a first end and a contact portion at a second, opposite end of the first terminal from the lead; and the second terminal is configured to come into and out of direct physical contact with the contact portion of the first terminal.

2. The switch-equipped connector according to claim 1, further comprising a base member having one surface on which the first terminal and the second terminal are mounted and the other surface on which the magnet is mounted, the base member being made of an insulating material.

3. The switch-equipped connector according to claim 1, wherein the magnetic metal of at least one of the first terminal and the second terminal is coated with metal plating.

4. The switch-equipped connector according to claim 3, wherein the metal plating is Au plating.

5. The switch-equipped connector according to claim 1, wherein in an unconnected state, the second terminal is configured to contact the first terminal and in a connected state the second terminal is configured to become out of contact with the first terminal.

6. The switch-equipped connector according to claim 5, wherein, in the connected state, a portion of the second terminal is displaced in a direction towards the magnet.

7. The switch-equipped connector according to claim 2, wherein the first terminal is fixed relative to the second terminal and the base member.

8. The switch-equipped connector according to claim 2, wherein the one surface is positioned in a location that is in opposition to the other surface.

9. The switch-equipped connector according to claim 2, wherein the one surface and the other surface are non-adjacent surfaces.

10. The switch-equipped connector according to claim 2, wherein the second terminal overlaps a center of the magnet when viewed in a plan view.

* * * * *